US011785992B2

(12) United States Patent
Morgan et al.

(10) Patent No.: US 11,785,992 B2
(45) Date of Patent: Oct. 17, 2023

(54) SOCK WITH KNITTED STRAPS

(71) Applicant: NIKE, Inc., Beaverton, OR (US)

(72) Inventors: Amir H. Morgan, Hillsboro, OR (US); Ronen Yehuda, Caesarea (IL)

(73) Assignee: NIKE, Inc., Beaverton, OR (US)

( * ) Notice: Subject to any disclaimer, the term of this patent is extended or adjusted under 35 U.S.C. 154(b) by 32 days.

(21) Appl. No.: 16/700,215

(22) Filed: Dec. 2, 2019

(65) Prior Publication Data

US 2020/0170308 A1 Jun. 4, 2020

Related U.S. Application Data

(60) Provisional application No. 62/774,499, filed on Dec. 3, 2018.

(51) Int. Cl.
*A41B 11/04* (2006.01)
*A41B 11/12* (2006.01)

(52) U.S. Cl.
CPC ..... *A41B 11/04* (2013.01); *A41B 11/12* (2013.01)

(58) Field of Classification Search
USPC ..... 24/712
See application file for complete search history.

(56) References Cited

U.S. PATENT DOCUMENTS 205,129 A * 6/1878 Packard ..... A43C 1/00 36/50.1
391,005 A * 10/1888 Munsing ..... D04B 1/14 66/200
1,284,836 A * 11/1918 Warner ..... A41B 11/00 2/239
1,563,877 A * 12/1925 Sonn ..... A41B 11/12 2/240

(Continued)

FOREIGN PATENT DOCUMENTS

CA 2809939 A1 * 2/2014 ..... A41B 11/125
CN 1067278 A 12/1992

(Continued)

OTHER PUBLICATIONS

TECHknitting, "Mysteries of knitting Part 1—A tale of heads and arms, or: 'why does stockinette curl but ribbing doesn't?' ," Mar. 1, 2007 (Year: 2007).*

(Continued)

*Primary Examiner* — Jocelyn Bravo
(74) *Attorney, Agent, or Firm* — SHOOK, HARDY & BACON L.L.P.

(57) ABSTRACT

Aspects herein are directed to a sock having a first knitted strap extending from a lateral aspect of a collar of the sock, and a second knitted strap extending from a medial aspect of the collar of the sock. Each of the first knitted strap and the second knitted strap is knit with a plurality of courses extending from a first longitudinal edge to a second longi- (Continued)

tudinal edge of the respective knitted strap where at least a portion of the courses are formed using an elastomeric yarn. Use of an elastomeric yarn extending widthwise across each knitted strap causes the longitudinal edges of the knitted strap to curl toward a respective longitudinal midline along the technical back of the knitted strap which, in turn produces a tubular-like shape for each of the first knitted strap and second knitted strap.

10 Claims, 5 Drawing Sheets

(56) References Cited

U.S. PATENT DOCUMENTS 1,572,084 A * 2/1926 Regar ..... D04B 1/06 66/173
1,597,410 A * 8/1926 Hinchliff ..... D04B 1/24 66/171
1,823,736 A * 9/1931 Goodman ..... A41B 11/12 2/240
1,888,172 A * 11/1932 Joha ..... A43B 1/02 66/177
2,110,890 A * 3/1938 Paul ..... A43B 5/12 36/8.3
2,147,197 A * 2/1939 Glidden ..... A43B 23/0235 36/9 R
2,170,741 A * 8/1939 Ware ..... D04B 1/10 66/197
2,192,798 A * 3/1940 Page ..... D04B 1/106 66/173
2,228,404 A * 1/1941 Saftlas ..... A41F 11/16 2/240
2,330,199 A * 9/1943 Basch ..... D04B 1/12 66/172 E
2,349,746 A * 5/1944 Morris ..... D04B 1/26 66/172 E
2,526,663 A * 10/1950 Holland ..... A41B 11/00 2/239
2,703,405 A * 3/1955 Smallberg, Sr. ..... A61F 13/043 2/239
2,816,541 A * 12/1957 Schultz ..... A61F 5/0111 602/27
3,146,468 A * 9/1964 McDonald ..... A41B 11/121 2/239
3,274,804 A * 9/1966 Thorneburg ..... D04B 1/106 66/171
3,307,379 A * 3/1967 Adams ..... D04B 9/10 66/178 R
3,315,276 A * 4/1967 Daxe ..... A41B 11/00 2/239
3,327,410 A * 6/1967 Park, Sr. ..... A43B 5/00 36/89
3,421,513 A * 1/1969 Landau ..... D04B 1/246 450/27
3,425,246 A * 2/1969 Knohl ..... D04B 1/243 66/171
3,487,830 A * 1/1970 Pruett ..... A61F 13/043 602/11
3,492,674 A * 2/1970 Poole ..... A41B 11/00 2/239
3,537,279 A * 11/1970 Epley ..... D04B 1/246 66/176
3,937,218 A * 2/1976 Gaylord, Jr. ..... A41D 13/0568 128/892
3,986,501 A * 10/1976 Schad ..... A61F 5/0111 602/28
3,990,115 A * 11/1976 Nester ..... A41B 11/00 2/239
4,169,324 A * 10/1979 Gibbs ..... A43B 17/18 2/239
4,282,727 A 8/1981 Dunlap et al.
4,326,393 A 4/1982 Dunlap
4,477,928 A * 10/1984 Graff ..... D04C 1/02 2/221
4,499,742 A * 2/1985 Burn ..... D04B 1/26 66/172 E
4,596,387 A * 6/1986 Roberts ..... A63B 21/4017 24/68 SK
4,843,653 A * 7/1989 Coble ..... D04B 1/106 2/170
4,853,275 A * 8/1989 Tracy ..... A41F 15/005 428/178
4,878,148 A * 10/1989 Hee ..... A61N 1/14 361/220
5,035,069 A * 7/1991 Minden ..... A43B 5/12 36/113
5,257,969 A * 11/1993 Mance ..... A61F 5/0113 36/8.3
5,566,396 A * 10/1996 Leib ..... A41B 11/003 2/239
D375,196 S 11/1996 Kluttz et al.
D380,892 S 7/1997 Paracho
D382,994 S 9/1997 Kluttz et al.
D393,548 S * 4/1998 Garneau ..... D5/47
5,928,059 A * 7/1999 Wicks ..... A41C 1/10 450/155
5,931,023 A * 8/1999 Brach ..... D04B 1/18 66/146
5,946,944 A * 9/1999 Osborne ..... D04B 1/102 66/176
5,970,524 A * 10/1999 Becker ..... A41B 11/002 2/239
6,003,345 A * 12/1999 Jordan ..... D04B 1/106 66/187
6,227,011 B1 * 5/2001 Cortinovis ..... A41D 20/00 2/171
6,298,496 B1 10/2001 Evans
6,493,910 B1 * 12/2002 Dischler ..... D06M 23/10 24/712
6,602,216 B1 * 8/2003 Nordt, III ..... A61F 5/0111 602/28
6,968,602 B2 11/2005 Lee et al.
8,225,530 B2 * 7/2012 Sokolowski ..... A43B 23/04 36/9 R
8,505,120 B2 * 8/2013 Lambertz ..... A61F 13/066 2/239
D698,139 S 1/2014 Wang et al.
8,826,469 B2 * 9/2014 London ..... A41D 13/0007 2/455
D718,041 S 11/2014 McAndrew
8,991,070 B2 * 3/2015 Kray ..... A43B 19/00 36/10
9,320,637 B2 * 4/2016 Amanatullah ..... A61F 5/0585
9,328,436 B2 * 5/2016 Russell ..... D03D 15/56
9,907,363 B2 * 3/2018 Smith ..... A43C 11/1493
10,368,590 B2 * 8/2019 Diaz ..... A41C 3/0085
10,368,606 B2 * 8/2019 Meir ..... A43B 1/0018
10,383,373 B2 * 8/2019 Muhlenfeld ..... A41B 1/08
10,448,688 B2 * 10/2019 Cassell ..... A41F 13/00
10,669,655 B2 * 6/2020 Hilton ..... H04R 1/02
10,782,093 B2 * 9/2020 Dilling ..... F41C 33/002
10,827,797 B2 * 11/2020 Hsu ..... A43B 23/227
10,882,231 B2 * 1/2021 Itzhak-Sigron ... B29C 45/14786
2003/0033729 A1 * 2/2003 Farrior ..... A43B 3/00 36/8.3
2003/0131634 A1 * 7/2003 Sciacca ..... D04B 1/24 66/64
2004/0011085 A1 * 1/2004 Sciacca ..... D04B 1/24 66/8
2005/0172379 A1 * 8/2005 Bush ..... A41B 11/125 2/123
2005/0273988 A1 * 12/2005 Christy ..... A43C 9/04 24/712.1
2007/0000149 A1 * 1/2007 Juniman ..... A43B 5/12 36/8.3
2008/0034613 A1 * 2/2008 Wilkenfeld ..... A43B 13/16 36/8.3

(56) References Cited

U.S. PATENT DOCUMENTS

| | | | | |
|---|---|---|---|---|
| 2008/0110049 | A1* | 5/2008 | Sokolowski | A43C 1/04 36/50.1 |
| 2009/0151200 | A1* | 6/2009 | Niedermeyer | A43B 13/026 36/88 |
| 2009/0293173 | A1* | 12/2009 | Gudzak | A41D 19/01 2/160 |
| 2011/0212668 | A1* | 9/2011 | Mitchell | D04B 1/246 450/86 |
| 2014/0041099 | A1 | 2/2014 | Boyd et al. | |
| 2014/0165267 | A1* | 6/2014 | McKee | A41B 11/08 2/239 |
| 2014/0272224 | A1 | 9/2014 | Gabouillet et al. | |
| 2015/0082662 | A1* | 3/2015 | Farris | A43B 23/0205 36/84 |
| 2015/0096107 | A1* | 4/2015 | Krumel | A41B 11/008 2/239 |
| 2016/0338418 | A1* | 11/2016 | Harris | A41B 11/08 |
| 2018/0220742 | A1* | 8/2018 | Liu | A43C 9/00 |
| 2018/0235836 | A1* | 8/2018 | Green | A41B 11/02 |

FOREIGN PATENT DOCUMENTS

| | | | | |
|---|---|---|---|---|
| CN | 1122568 | A | 5/1996 | |
| CN | 201648674 | U | 11/2010 | |
| CN | 202095543 | U | 1/2012 | |
| CN | 202588274 | U | 12/2012 | |
| CN | 202800124 | U | 3/2013 | |
| CN | 203676172 | U | 7/2014 | |
| CN | 105247127 | A | 1/2016 | |
| CN | 107173856 | A | 9/2017 | |
| CN | 207784301 | U | 8/2018 | |
| DE | 202016105948 | U1 * | 11/2016 | A41B 11/123 |
| EP | 1 391 159 | A1 | 2/2004 | |
| FR | 2956314 | A1 * | 8/2011 | A41B 11/121 |
| GB | 358255 | A | 10/1931 | |
| GB | 480266 | A | 2/1938 | |
| GB | 1 381 209 | A | 1/1975 | |
| GB | 1 414 128 | A | 11/1975 | |
| JP | 3038793 | U | 6/1997 | |
| JP | 2016-169453 | A | 9/2016 | |
| KR | 200351598 | Y1 | 5/2004 | |
| KR | 200351598 | Y1 * | 5/2004 | |
| KR | 10-2010-0037732 | A | 4/2010 | |
| KR | 10-2017-0042885 | A | 4/2017 | |
| WO | WO-2012006654 | A1 * | 1/2012 | A41B 11/125 |

OTHER PUBLICATIONS

The Blue Mouse, "Emerald Top" Knitting Pattern, Jun. 2017 (Year: 2017).*

Ravelry, "Emerald Tank Top by The Blue Mouse" pattern listing, pub. Jun. 2017 (Year: 2017).*

Translation of KR200351598Y1, provided by Espacenet Patent Translate; translation provided on Aug. 25, 2022 (Year: 2022).*

International Preliminary Report on Pantentability received for PCT Patent Application No. PCT/US2019/064160, dated Jun. 17, 2021, 10 pages.

"5 Colors Lace Bandage Lolita Ballet Socks", Retrieved from Internet URL: spreepicky.com, on Aug. 20, 2018, pp. 3.

"Free People Dancing Under Stars Ballet Socks", Poshmark, Retrieved from Internet URL: poshmark.com, on Aug. 18, 2018, pp. 7.

"Lucky Honey Grip Sock Pink", PB—Palm Beach Athletic Wear, Retrieved from Internet URL: palmbeachathleticwear.com, on Aug. 2018, pp. 3.

"Women Professional Ballet Socks Half Five Toe", Best Yoga Store, Retrieved from Internet URL: bestyogastore.us on Aug. 2, 2018, pp. 13.

International Search Report and Written Opinion received for PCT Patent Application No. PCT/US2019/064160, dated Mar. 10, 2020, 17 pages.

Intention to Grant received for European Patent Application No. 19828030.7, dated Mar. 13, 2023, 7 pages.

* cited by examiner

SOCK WITH KNITTED STRAPS

CROSS-REFERENCE TO RELATED APPLICATIONS

This application, assigned U.S. application Ser. No. 16/700,215, filed Dec. 2, 2019, and entitled "Sock with Knitted Straps," claims the benefit of priority of U.S. Prov. App. No. 62,774,499, filed Dec. 3, 2018, and entitled "Sock with Knitted Straps." The entirety of the aforementioned application is incorporated by reference herein.

TECHNICAL FIELD

Aspects herein are directed to a sock with knitted laces or straps.

BACKGROUND

Traditional laces used to secure, for instance, shoes to a wearer's feet, are generally formed by a braiding process or a weaving process. Moreover, in instances where socks comprise laces or straps, the laces or straps are typically added in a post-processing step by, for instance, stitching or affixing the lace or strap to the sock.

DESCRIPTION OF THE DRAWINGS

Examples of aspects herein are described in detail below with reference to the attached drawing figures, wherein.

DETAILED DESCRIPTION

Figure 1:
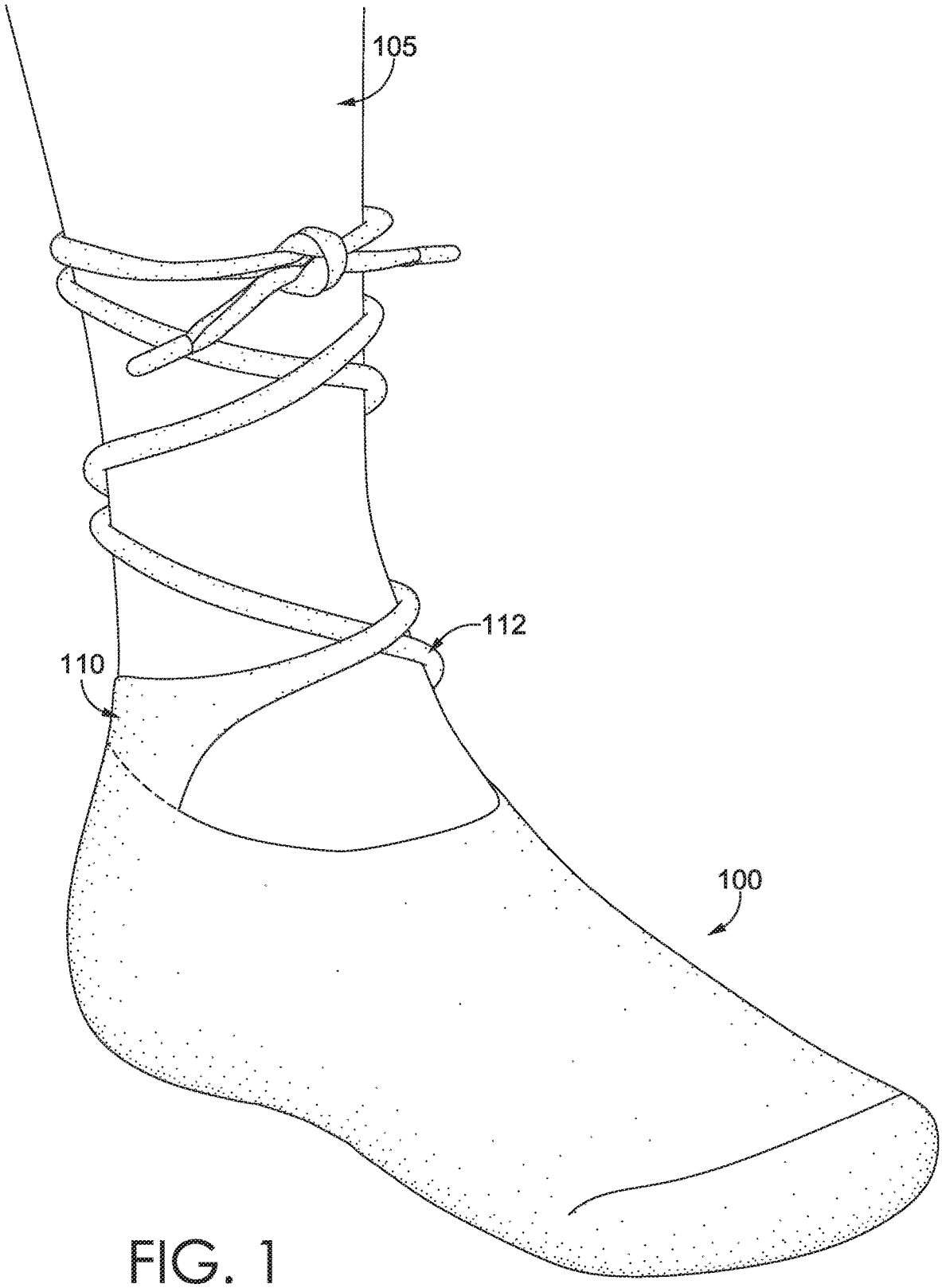
FIG. 1 illustrates a wearer wearing a sock having knitted straps in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to a sock having an integrally knitted lace or knitted strap structure, where the longitudinal edges of the knitted strap turn or curl inward to form a tubular-like structure. The sock thus described saves on manufacturing costs and time as the straps are integrally knit with the sock body thereby decreasing post-knitting processing steps. As well, the sock thus described provides a knitted strap that is easy to manipulate due to its tubular-like structure.

As used herein, the term "knitted strap" or "knitted lace" means a cord or strip used to secure an article, such as a sock, to a body part of a wearer. The term "lace" is not meant to imply an ornamental fabric in which threads are looped, twisted, or otherwise manipulated to produce an open fabric used in trimming a garment or apparel item. To avoid confusion with the term "lace," the term "knitted strap" will be used herein.

In aspects, the knitted strap structure comprises a first knitted strap extending from a medial aspect of a collar of the sock, and a second knitted strap extending from a lateral aspect of the collar of the sock. Each of the first knitted strap and the second knitted strap comprises a first end extending from the collar of the sock, a detached second end, a first longitudinal edge, a second longitudinal edge opposite and parallel to the first longitudinal edge, a technical face, and a technical back opposite the technical face. Continuing, each of the first knitted strap and the second knitted strap is knit with a plurality of courses each extending widthwise between the first longitudinal edge and the second longitudinal edge of the respective knitted strap where at least a portion of the courses are formed using an elastomeric yarn. To describe this differently, each of the plurality of knitted courses is oriented perpendicular to the first longitudinal edge and the second longitudinal edge of the knitted strap. In one example aspect, the first and second knitted straps are knit with a non-elastomeric body yarn that is plated with an elastomeric yarn so that the non-elastomeric body yarn is positioned on the technical face of the knitted strap and the elastomeric yarn is primarily positioned on the technical back of the knitted strap. In further example aspects, both the body yarn and the plated elastomeric yarn are tightly knit (i.e., knit to have small loops).

Use of a tightly knit elastomeric yarn extending widthwise across at least the technical back of each knitted strap causes the longitudinal edges of the knitted strap to curl toward a respective longitudinal midline along the technical back of the knitted strap which, in turn produces a tubular-like shape for each of the first knitted strap and the second knitted strap. However, unlike traditional tubular structures where there are no free longitudinal edges (i.e., the tubular structure is hollow and is circumscribed by tube walls), aspects herein contemplate that the first longitudinal edge remains unaffixed from or free from the second longitudinal edge of the respective knitted strap along at least a portion of the length of the knitted strap.

To describe this aspect a different way, because of the widthwise orientation of the elastomeric yarns in the courses, the technical face extending from the first longitudinal edge of each knitted strap is turned toward the technical back extending from the first longitudinal edge of each knitted strap. Similarly, the technical face extending from the second longitudinal edge of each knitted strap is turned toward the technical back extending from the second longitudinal edge of each knitted strap. In example aspects, the technical face extending from the first longitudinal edge of each knitted strap is in contact or near contact with the technical face extending from the second longitudinal edge of each knitted strap at the technical back of the respective knitted strap to form the tubular-like shape for each of the first knitted strap and the second knitted strap. The result of this is that when the knitted strap is in a resting state, the technical back of the knitted strap is generally not exposed or is covered by the technical face of the respective knitted strap due to the curling in of the longitudinal edges toward the longitudinal midline along the technical back of the respective knitted strap.

As described above, it is contemplated herein that the first knitted strap and the second knitted strap may be integrally knit with the sock. In example aspects, the first knitted strap and the second knitted strap may be knit through a reciprocating motion on a circular knit machine. For instance, the first knitted strap may be knit on the circular knit machine using only a first set of the needles, while the remaining needles are inactive. The first set of needles perform a reciprocating knitting motion to form the first knitted strap. After the first knitted strap is knit, the second knitted strap is knit using a second set of the needles, while the remaining needles are inactive. The second set of needles perform a reciprocating knitting motion to form the second knitted strap. After the second knitted strap is knit, the first and second knitted straps may be integrally knit with the sock body where the sock body is knit in a circular fashion using all the needles of the circular knit machine. In example aspects, the first end of each of the first knitted strap and the second knitted strap (i.e., the end that is integrally knit with the sock body) has a width that is wider than remaining portions of the respective knitted strap to provide a more secure attachment to the sock body and more specifically to the collar of the sock body.

The result of the structure and process described above is a sock with integrally knitted straps that can be wrapped one or more times around a wearer's lower leg to provide a secure attachment of the sock to the wearer and to provide an interesting visual aesthetic. Moreover, because the knitted straps are integrally knit with the sock body, the number of manufacturing steps used to form the sock and knitted strap structure is reduced. In addition, the tubular-like shape of the knitted straps provides for easy manipulation by a wearer. Another advantage is that the knitted straps may assist a wearer with donning the sock. For example, the wearer may grasp the detached second ends of the knitted straps, insert his foot into the foot opening of the sock, and use the knitted straps to pull the sock onto his foot. This may be especially useful for wearers with, for instance, back problems that prevent the wearer from fully leaning forward or for people suffering from other types of disabilities.

Positional terms as used herein such as "medial," "lateral," and the like, are with a sock being worn as intended and as shown and described herein by a wearer standing in anatomical position. Thus, the medial side of the sock would be positioned on the medial side of a wearer's foot and/or leg, and the lateral side of the sock would be positioned on the lateral side of the wearer's foot and/or leg. The term "knitted course" as described herein is a predominantly horizontal row of knitted loops (in an upright fabric as knit) produced by adjacent needles during the same knitting cycle. The knitted course may comprise one or more stitch types such as a loop stitch, a held stitch, a float stitch, a tuck stitch, a transfer stitch, and the like as these terms are known in the art of knitting. The term "plating" as used herein means a knit construction where a body yarn and a plating yarn are knitted in the same knit stitch using, for instance, a body yarn feeder and a plating yarn feeder. In the plated construction contemplated herein, the body yarn is positioned to form the technical face of the fabric, while the plating yarn is positioned behind the body yarn to form the technical back of the fabric. However, due to irregularities in the plating process, the plating yarn may occasionally be present on the technical face of the fabric, and the body yarn may occasionally be present on the technical back of the fabric.

Continuing, the term "technical back" as used herein refers to the inner side or underside of the fabric or textile as it is being knit. The term "technical back" may also be defined as the side of the fabric or textile that contains back loops or purl loops. And the term "technical face" as used herein refers to the outer or upper side of the fabric or textile as it is being knit. The term "technical face" may also be defined as the side of the fabric or textile that contains face loops or weft knit loops. The term "integrally knit" as used herein may mean a textile or fabric having a yarn from one or more knitted courses being interlooped with one or more knitted courses of another area. For instance, a knitted strap may be integrally knit with the collar of a sock if a yarn from one or more knitted courses of the collar is interlooped with one or more knitted courses in the knitted strap. The term "elastomeric" as used herein when describing yarns generally means a yarn type that may provide a maximum stretch greater than about 200% under load prior to returning to its non-stretched state when the load is removed, and some elastomeric yarns provide a maximum stretch of about 400%. Examples of elastomeric yarn types include, Lycra®, elastane, Spandex®, rubber, and the like and may comprise covered or uncovered yarns.

Continuing, the term "resting state" used when describing the knitted strap means the knitted strap as it exists without intentional tensioning or deformation forces applied to the knitted strap. For example, as described above, the knitted straps described herein assume a tubular-like shape in a resting state. However, the knitted strap can be made to assume a flattened state (i.e., a state where the technical face is generally planar with respect to the technical back) by intentionally uncurling the longitudinal edges of the knitted strap. The flattened state as described may also be known as a "deformed" state to indicate that the knitted strap is artificially deformed or manipulated into the flattened state. The term "about" used when, for instance, describing numerical ranges means within ±10% of a designated value unless indicated otherwise. Unless indicated otherwise, all measurements provided herein are taken when the sock is at ambient temperature and pressure (298.15 K, 100 kPa) and is in a resting state.

Turning now to FIG. 1, a wearer 105 is shown wearing a sock 100 having a first knitted strap 110 and a second knitted strap 112 in accordance with aspects herein. The sock 100 is shown in the form of a liner sock or a ped sock although other sock lengths are contemplated herein such as a no-show sock, a quarter sock, a crew sock, or an over the calf or executive sock. FIG. 1 is provided to illustrate an example way of wearing the sock 100. For instance, the sock 100 may be donned, and the first knitted strap 110 and the second knitted strap 112 may be wrapped one or more times around, for example, the ankle and calf area of the wearer 105 before tying the first knitted strap 110 to the second knitted strap 112. When the sock 100 is in the form of a crew sock or an executive sock, aspects herein contemplate the first knitted strap 110 and the second knitted strap 112 extending to the knee region or past the knee region in example aspects.

Figure 2:
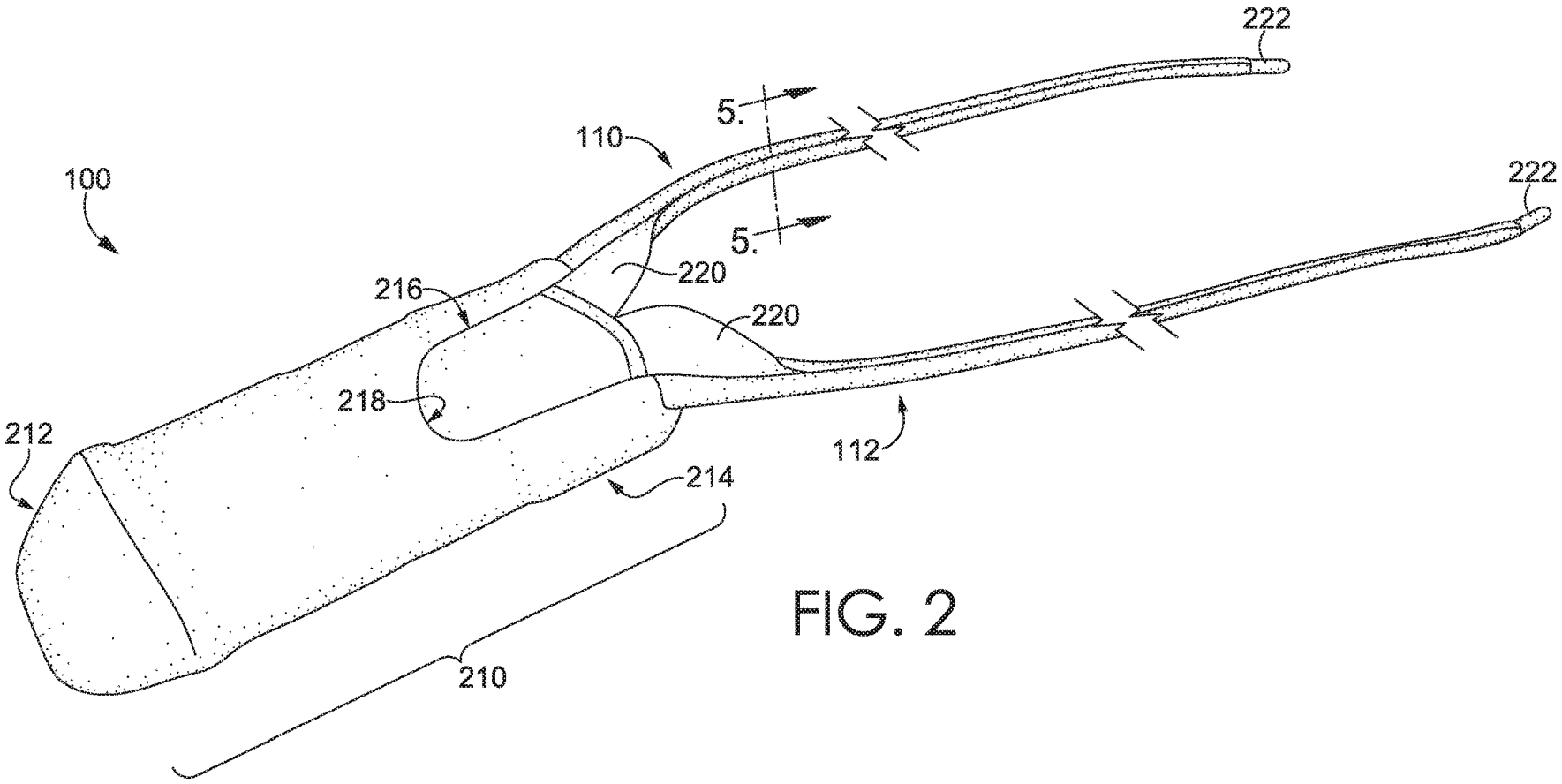
FIG. 2 illustrates a perspective view of a sock having knitted straps in accordance with aspects herein.

FIG. 2 illustrates a perspective view of the sock 100 in an un-worn state in accordance with aspects herein. Aspects herein contemplate that the sock 100 is knit on a circular knit machine. Aspects herein further contemplate that the first and second knitted straps 110 and 112 are also formed through a knitting process including a reciprocal knitting process on a circular knit machine. The sock 100 is foot-agnostic in some aspects, but it is also contemplated herein that the sock 100 could be formed having features adapting the sock 100 to a left foot or a right foot of a wearer. For illustrative purposes, the sock 100 will be described as if it is a sock being worn on a right foot of a wearer as shown in FIG. 1. The sock 100 comprises a sock body 210 having a toe area 212 and a heel area 214. The sock body 210 further comprises a collar 216 that defines a foot opening 218 for receiving a foot of a wearer. In example aspects, the collar 216 may comprise one or more welts (not shown) that help to define, at least in part, the foot opening 218.

Continuing, the sock 100 further comprises the first knitted strap 110 extending from a lateral aspect of the collar 216, and the second knitted strap 112 extending from a medial aspect of the collar 216. Each of the first knitted strap 110 and the second knitted strap 112 comprises a first end 220 and a second end 222 with an intervening length extending between the first end 220 and the second end 222. In example aspects, and as explained further below, the first end 220 of the first and second knitted straps 110 and 112 may be integrally knit with the sock body 210. It is also contemplated herein, that the first end 220 of the first and second knitted straps 110 and 112 may be attached to the collar 216 of the sock body 210 in a post-knitting step by, for example, stitching, bonding, use of an adhesive, and the like. The second end 222 of the first and second knitted straps 110 and 112 may comprise a detached end with an optional aglet as shown.

Each of the first knitted strap 110 and the second knitted strap 112 is shown with break lines to indicate that the first and second knitted straps 110 and 112 may comprise a range of lengths. In example aspects, each of the first knitted strap 110 and the second knitted strap 112 may comprise a length from about 40 cm to about 100 cm, from about 50 cm to about 90 cm, or from about 60 cm to about 85 cm. Lengths above and below these ranges are also contemplated herein. Having a longer length enables the first and second knitted straps 110 and 112 to be wrapped one or more times around the wearer's calf. A longer length of the first and second knitted straps 110 and 112 may also assist a wearer in donning the sock 100 as described above.

FIG. 2 further illustrates how in some example aspects, the first ends 220 of the first knitted strap 110 and the second knitted strap 112 may have a greater width than remaining portions of the first and second knitted straps 110 and 112. This will be discussed in greater depth below, but use of a wider first end 220 for the first and second knitted straps 110 and 112 provides a longer attachment edge of the first and second knitted straps 110 and 112 to the collar 216 of the sock body 210 whether the attachment is through integrally knitted stitches or some other attachment methodology (i.e., stitching). Having a longer edge for attachment, in turn, may provide a more secure attachment of the first and second knitted straps 110 and 112 to the collar 216 of the sock body 210.

Figure 3:
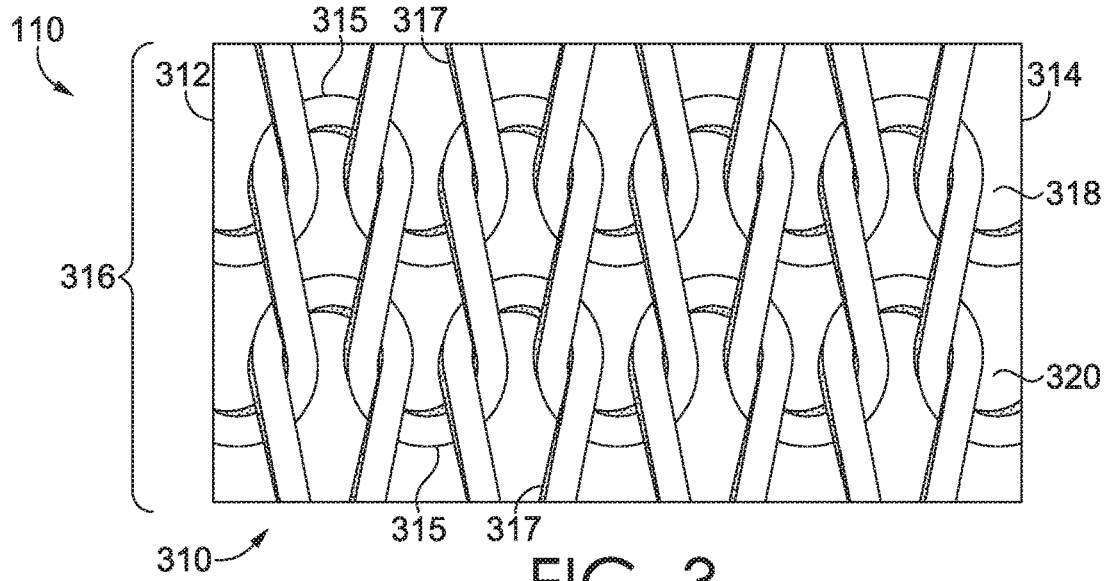
FIG. 3 illustrates a technical face of an example knitted strap of FIG. 2 in accordance with aspects herein.
Figure 4:
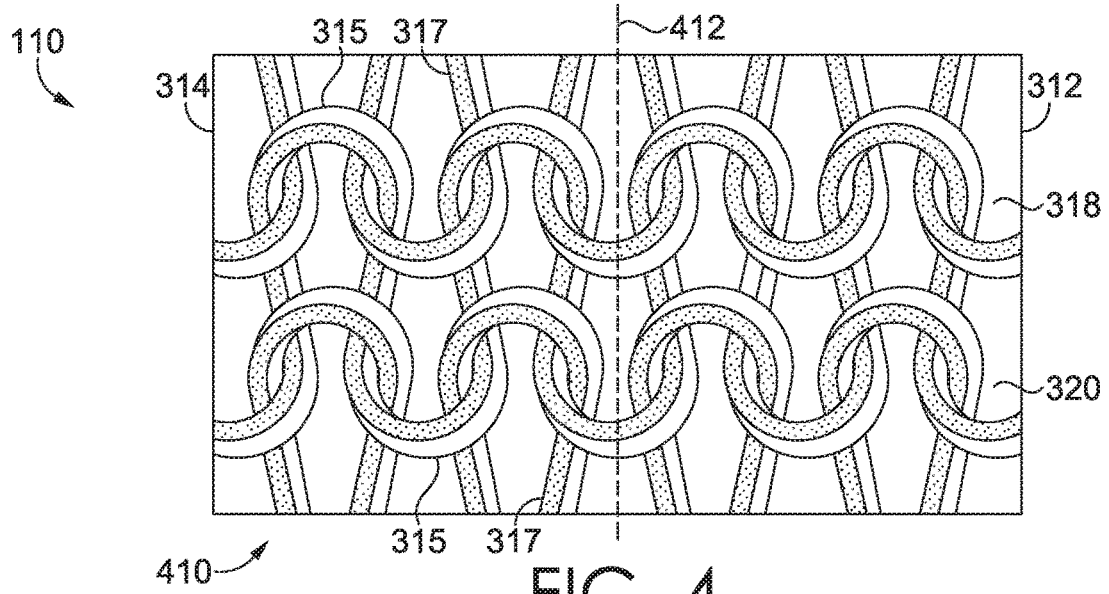
FIG. 4 illustrates a technical back of the example knitted strap of FIG. 2 in accordance with aspects herein.

FIGS. 3 and 4 show a portion of the first knitted strap 110 in accordance with aspects herein. The description of the first knitted strap 110 with respect to FIGS. 3 and 4 is equally applicable to the second knitted strap 112. The depiction of the knitted loops in FIGS. 3 and 4 is enlarged to better illustrate concepts herein. As such, although a limited number of knitted loops is illustrated in the portion of the first knitted strap 110 shown in FIGS. 3 and 4, it is contemplated herein that the portion of the first knitted strap 110 may comprise a greater number of knitted loops than those shown in FIGS. 3 and 4. For instance, in example aspects, the first knitted strap 110 may comprise from about 10 to about 30 wales extending parallel to and located between a first longitudinal edge 312 and a second longitudinal edge 314 of the first knitted strap 110, from about 15 to about 25 wales extending parallel to and located between the first longitudinal edge 312 and the second longitudinal edge 314, or from about 18 to about 23 wales extending parallel to and extending between the first longitudinal edge 312 and the second longitudinal edge 314.

The first knitted strap 110 comprises a technical face 310 (shown in FIG. 3), a technical back 410 (shown in FIG. 4), the first longitudinal edge 312, and the second longitudinal edge 314 opposite the first longitudinal edge 312. The first and second longitudinal edges 312 and 314 extend in a lengthwise direction of the first knitted strap 110. The first knitted strap 110 is shown in a deformed state in FIGS. 3 and 4 such that the first and second longitudinal edges 312 and 314 are unrolled and the technical face 310 is in a generally planar configuration with the technical back 410. The first knitted strap 110 is shown in a deformed state to illustrate aspects associated with the knitted structure and to more clearly define the first and second longitudinal edges 312 and 314. As shown in FIG. 4, the first knitted strap 110 may also comprise a hypothetical longitudinal midline 412 extending parallel to the long axis of the first knitted strap 110 and bisecting the first knitted strap 110 into generally equal first and second longitudinal sides.

In example aspects, the first knitted strap 110 comprises a plated construction where a body yarn 315 is positioned generally on the technical face 310 of the first knitted strap 110 and an elastomeric yarn 317 (indicated with stippling) that is plated with the body yarn 315, is positioned generally on the technical back 410 of the first knitted strap 110. In example aspects, the body yarn 315 may comprise a polyester yarn formed from six individual polyester yarns (e.g., six "ends") each having a denier of about 60 to about 70 denier, or about 68 denier, that are twisted together to form the body yarn 315. As well, the elastomeric yarn 317 may comprise, in example aspects, a 20 denier elastomeric yarn, such as a spandex yarn, covered with, for instance, polyester or nylon. Use of a high denier, heavy body yarn, such as the body yarn 315, may contribute to the structural stability of the first knitted strap 110, which, in turn, may allow for easier manipulation by a wearer. This is opposed to a knitted strap formed from, for example, a small or fine denier yarn that may easily fold or bend making it more difficult to grasp. And use of the elastomeric yarn 317 may impart at least a vertical stretch characteristic to the first knitted strap 110 (i.e., stretch along the longitudinal length of the first knitted strap 110 or stretch in a wale-wise direction). As well, positioning the elastomeric yarn 317 on the technical back 410 of the first knitted strap 110 may help the first and second longitudinal edges 312 and 314 curl inward to form the tubular-like structure for the first knitted strap 110.

The first knitted strap 110 comprises a plurality of knitted courses 316, with knitted course 318 and knitted course 320 being representative examples, where each of the knitted courses 316 extends widthwise between the first longitudinal edge 312 and the second longitudinal edge 314. To describe this differently, each of the knitted courses 316 extends perpendicular to the longitudinal midline 412 of the first knitted strap 110 and extends perpendicular to the first longitudinal edge 312 and the second longitudinal edge 314. It is contemplated herein that at least a portion of the knitted courses 316 is knit using the elastomeric yarn 317. For instance, about 60% of the knitted courses 316 may comprise the elastomeric yarn 317, about 70% of the knitted courses 316 may comprise the elastomeric yarn 317, about 80% of the knitted courses 316 may comprise the elastomeric yarn 317, about 90% of the knitted courses 316 may comprise the elastomeric yarn 317, or about 100% of the knitted courses 316 may comprise the elastomeric yarn 317.

As will be explained more fully below, it is contemplated herein that the first and second knitted straps 110 and 112 may be knit on a 132 needle, 3.75 inch cylinder circular knit machine. The stitch cam on the machine may be adjusted to manipulate the needles to form a small loop/stitch when knitting the first and second knitted straps 110 and 112. Because of the tight knit structure of the knitted courses 316, and because the knitted courses 316 are knit using the elastomeric yarn 317, the first and second longitudinal edges 312 and 314 of the first knitted strap 110 curl in toward each other when the first knitted strap 110 is in a resting state. An additional result of the tight knit structure is that there is not an appreciable stretch characteristic in the widthwise direction (i.e., between the first longitudinal edge 312 and the second longitudinal edge 314) of the first knitted strap 110 even though the elastomeric yarn 317 is used.

Figure 5:
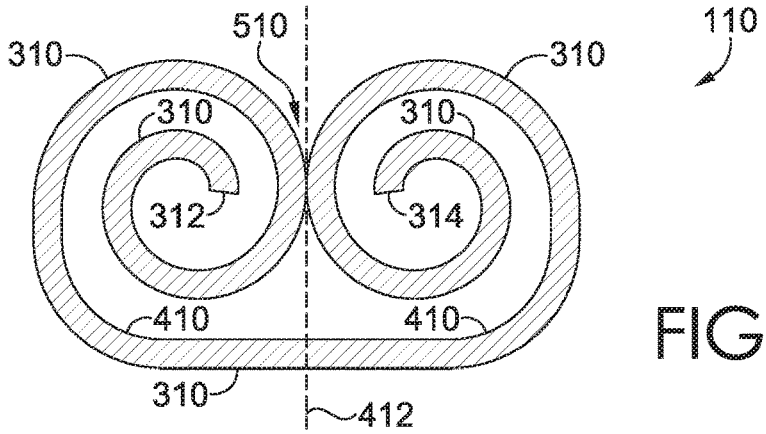
FIG. 5 illustrates a cross-section view taken along cut line 5-5 of FIG. 2 in accordance with aspects herein.

FIG. 5 illustrates a cross-section of the first knitted strap 110 taken along cut line 5-5 of FIG. 2 in accordance with aspects herein. A cross-section of the second knitted strap 112 would be similar. As well, the cross-section depicted in FIG. 5 may be descriptive of, for instance, an entirety or a substantial entirety of the intervening length of the first knitted strap 110 with the exception of, for example, the area where the first knitted strap 110 extends from the collar 216 and with the possible exception of where the aglet is attached to the second end 222. As illustrated, the first and second longitudinal edges 312 and 314 curl in toward each other with respect to the technical back 410 of the first knitted strap 110. More particularly, the technical face 310 extending from the first longitudinal edge 312 is turned toward the technical back 410 extending from the first longitudinal edge 312. Similarly, the technical face 310 extending from the second longitudinal edge 314 is turned toward the technical back 410 extending from the second longitudinal edge 314.

Continuing, in example aspects, it is contemplated herein that the technical face 310 extending from the first longitudinal edge 312 may be in contact or near contact (e.g., within about 1 mm to about 3 mm of each other) with the technical face 310 extending from the second longitudinal edge 314 at a location 510 corresponding generally to the longitudinal midline 412 (as used herein, the term "generally" means within ±5 mm of the longitudinal midline 412) along at least a portion of the length of the first knitted strap 110 when the first knitted strap 110 is in a resting state. In example aspects, the technical face 310 extending from the first longitudinal edge 312 may be in contact or near contact with the technical face 310 extending from the second longitudinal edge 314 along about 50% of the length of the first knitted strap 110, about 60% of the length of the first knitted strap 110, about 70% of the length of the first knitted strap 110, about 80% of the length of the first knitted strap 110, about 90% of the length of the first knitted strap 110, or about 100% of the length of the first knitted strap 110. It is further contemplated herein, that the first longitudinal edge 312 is unaffixed from (or not attached to, or free from) the second longitudinal edge 314 along about 50% of the length of the first knitted strap 110, about 60% of the length of the first knitted strap 110, about 70% of the length of the first knitted strap 110, about 80% of the length of the first knitted strap 110, about 90% of the length of the first knitted strap 110, or about 100% of the length of the first knitted strap 110. A result of the configuration thus described is that the first knitted strap 110 assumes a tubular-like shape in a resting state with the first and second longitudinal edges 312 and 314 of the tubular-like shape not being affixed to each other.

Figure 6:
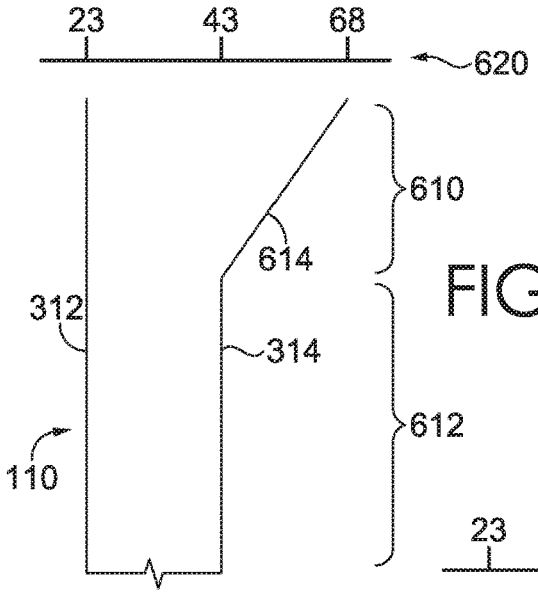
FIG. 6 illustrates a diagrammatic representation of knitting a first knitted strap in accordance with aspects herein.
Figure 7:
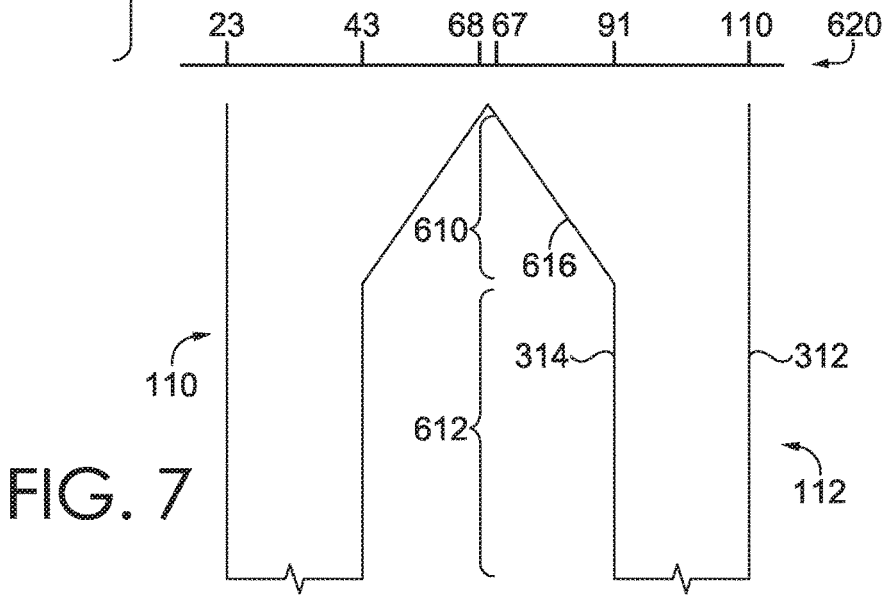
FIG. 7 illustrates a diagrammatic representation of knitting a second knitted strap in accordance with aspects herein.
Figure 8:
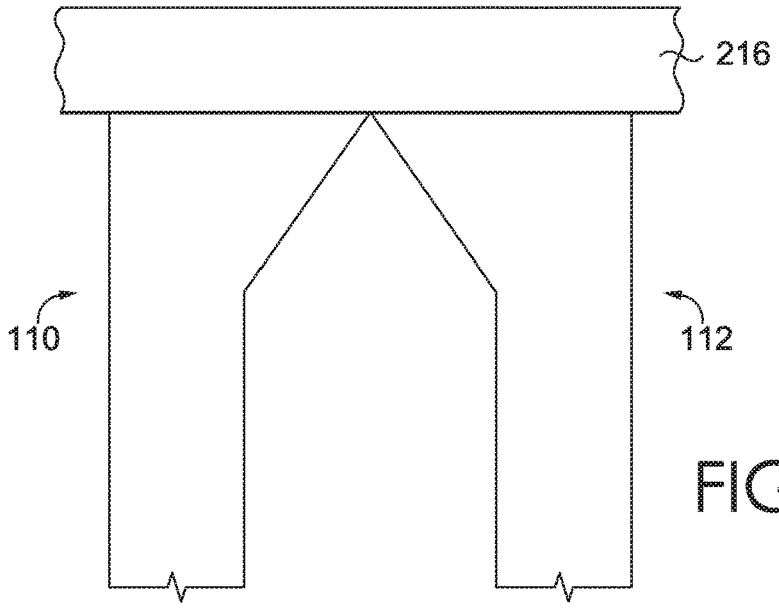
FIG. 8 illustrates a diagrammatic representation of knitting a sock body with the first knitted strap and the second knitted strap in accordance with aspects herein.

With reference to FIGS. 6-8, an example aspect of knitting the first knitted strap 110, the second knitted strap 112, and at least part of the sock body 210 on a circular knit machine is shown in a schematic fashion. Before describing FIGS. 6-8, a brief overview of the knitting process is described. In general, the knitting of the sock 100 starts at the second end 222 of the first knitted strap 110 and moves to the first end 220 of the first knitted strap 110. The first knitted strap 110 is then held by the knit needles while knitting of the second knitted strap 112 occurs. The knitting of the second knitted strap 112 starts at the second end 222 and moves to the first end 220 of the second knitted strap 112. At that point, all the needles on the circular knit machine are selected and the sock body 210 is knitted starting at the heel area 214 and/or the collar 216 of the sock body 210. This action also integrally knits the first ends 220 of the first and second knitted straps 110 and 112 with the sock body 210.

With initial reference to FIG. 6, a segment of the first knitted strap 110 is shown where the segment of the first knitted strap 110 represents the knitted area proximate the first end 220 of the first knitted strap 110. Further, numbered needles on a schematic cylinder 620 are depicted where the numbered needles represent the needle positions used to knit the first knitted strap 110. When the first knitted strap 110 is to be knit, the circular knit machine uses only a first set of the needles, while the remaining needles are inactive. In one example aspect, on a circular knit machine having 132 needles, the narrow portion 612 of the first knitted strap 110 is knit starting at the second end 222 of the first knitted strap 110 using only needles 23 through 43 in a reciprocating knitting motion between needles 23 through 43. When the wide portion 610 of the first knitted strap 110 is knit, adjacent needles on one side are successively added in a transfer process to form angled edge 614. In example aspects, needles 44 through 68 are added to form the wide portion 610 of the first knitted strap 110. The wide portion 610 is also knit in a reciprocating knitting motion. After the first knitted strap 110 is knit, it is held in place on the cylinder (i.e., needles 23 through 68 are held in a lower position without clearing their knit loops).

After the first knitted strap 110 is knit, the second knitted strap 112 is knit as shown in FIG. 7. To knit the second knitted strap 112, again only a second set of the needles on the circular knit machine are used, where the second set of needles is different from the first set of needles used to knit the first knitted strap 110. Continuing with the example aspect above, on a circular knit machine with 132 needles, the narrow portion 612 of the second knitted strap 112 is knit starting at the second end 222 of the second knitted strap 112 using only needles 91 through 110 in a reciprocating knitting motion between needles 91 through 110. When the wide portion 610 of the second knitted strap 112 is knit, adjacent needles on one side are successively added in a transfer process to form angled edge 616. In example aspects, needles 90 through 67 are added to form the wide portion 610 of the second knitted strap 112. The wide portion 610 is also knit in a reciprocating knitting motion.

FIG. 8 depicts an example aspect where the collar 216 of the sock body 210 is knit using all the needles on the circular knit machine. The first ends 220 of the first and second knitted straps 110 and 112 are integrally knit with the collar 216. It is also contemplated herein that in another example aspect, the first and second knitted straps 110 and 112 may be integrally knit with the sock body 210 in other ways. For example, the first ends 220 of the first and second knitted straps 110 and 112 may be integrally knit with a reciprocated panel that forms, at least in part, the heel area 214 of the sock body 210. The reciprocated panel is integrally knit with the sock body 210, where the sock body 210 is knit in a circular fashion using all of the needles on the circular knit machine. It should be understood that other circular knit machines, having a different number of needles could be used, with comparable needle ratios.

Figure 9:
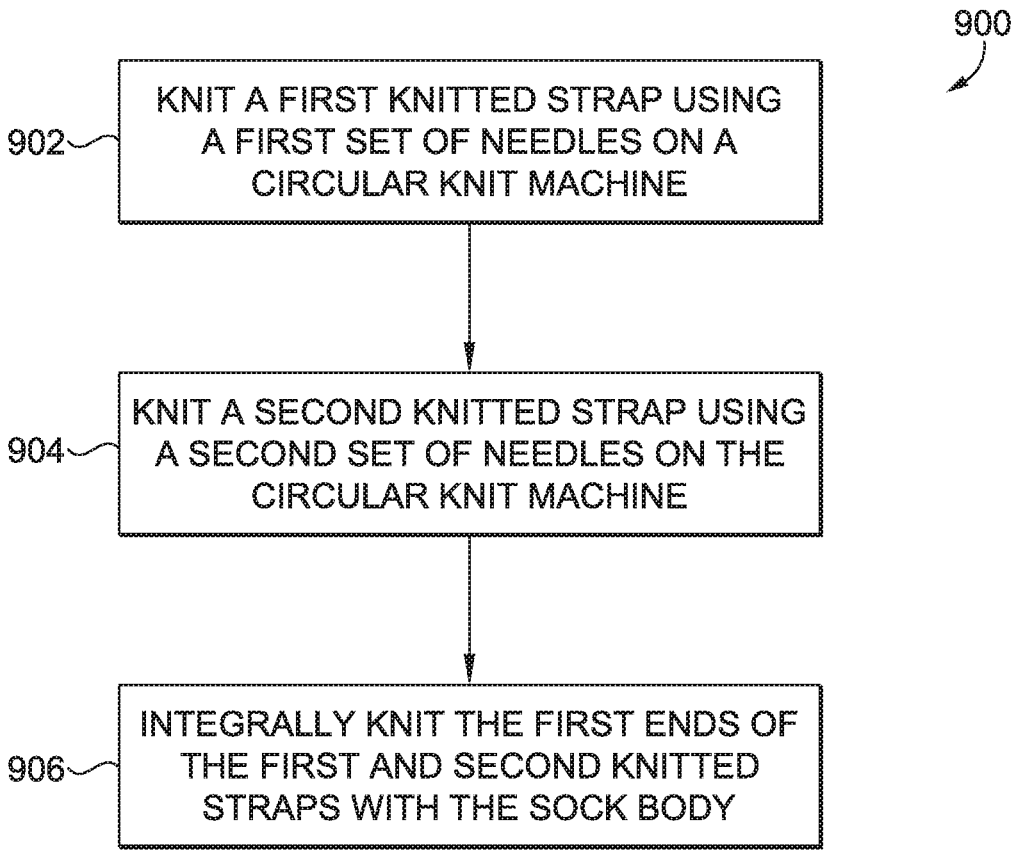
FIG. 9 illustrates a flow diagram of an example method of knitting a sock having one or more knitted straps in accordance with aspects herein.

Turning now to FIG. 9, a flow diagram of an example method 900 of forming a sock, such as the sock 100, is provided in accordance with aspects herein. At a step 902, a first knitted strap, such as the first knitted strap 110, is knit using, for example, a first set of needles acting in a reciprocating motion on a circular knit machine. An example circular knit machine comprises a 132 needle, 3.75 inch cylinder circular knit machine. The first knitted strap is knit from its second end, such as second end 222, in the direction toward its first end, such as first end 220. The first knitted strap comprises a first longitudinal edge, a second longitudinal edge opposite and parallel to the first longitudinal edge, a technical face, and a technical back. In example aspects, the technical face may be primarily formed (e.g., at least about 80% formed) from a non-elastomeric body yarn and the technical back may be primarily formed (e.g., at least about 80% formed) from an elastomeric yarn that is plated with the body yarn. Knitting the first knitted strap comprises knitting a plurality of courses extending widthwise between the first longitudinal edge and the second longitudinal edge of the first knitted strap, where at least a portion of the courses are knit using the elastomeric yarn. In example aspects, all the courses are knit using the elastomeric yarn.

Continuing, at a step 904, a second knitted strap, such as the second knitted strap 112, is then knit using, for example, a second set of needles acting in a reciprocating motion on the circular knit machine. While the second knitted strap is being knit, the first knitted strap is held by the first set of needles. The second knitted strap is knit from its second end in the direction toward its first end. The second knitted strap comprises a first longitudinal edge, a second longitudinal edge opposite and parallel to the first longitudinal edge, a technical face, and a technical back. In example aspects, the technical face may be primarily formed (e.g., at least about 80% formed) from a non-elastomeric body yarn and the technical back may be primarily formed (e.g., at least about 80% formed) from an elastomeric yarn that is plated with the body yarn. Knitting the second knitted strap also comprises knitting a plurality of courses extending widthwise between the first longitudinal edge and the second longitudinal edge of the second knitted strap, where at least a portion of the courses are knit using the elastomeric yarn. In example aspects, all the courses are knit using the elastomeric yarn.

At a step 906, the first ends of both the first knitted strap and the second knitted strap are integrally knit with the sock body on the circular knit machine. In example aspects, the first knitted strap is knit to extend from a lateral aspect of the collar of the finished sock. And the second knitted strap is knit to extend from a medial aspect of the collar of the finished sock. Additional method steps may comprise knitting a heel area of the sock body using a reciprocated panel.

In example aspects, subsequent to knitting (or during the knitting process) the first knitted strap and the second knitted strap, the technical face extending from the first longitudinal edge of each of the first knitted strap and the second knitted strap turns toward the technical back extending from the first longitudinal edge of each of the first knitted strap and the second knitted strap when the first knitted strap and the second knitted strap are in a resting state. As well, the technical face extending from the second longitudinal edge of each of the first knitted strap and the second knitted strap turns toward the technical back extending from the second longitudinal edge of each of the first knitted strap and the second knitted strap when the first knitted strap and the second knitted strap are in the resting state. This results in a tubular-like shape for the first knitted strap and the second knitted strap.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A sock comprising:

a sock body having a collar; and at least a first knitted strap having a first end extending from the collar of the sock body and a detached second end, the first knitted strap extending lengthwise from the first end to the second end and comprising a plurality of knitted courses extending in a widthwise direction of the first knitted strap, wherein at least a portion of the plurality of knitted courses comprises an elastomeric yarn.

Clause 2. The sock according to clause 1, further comprising a second knitted strap having a first end extending from the collar of the sock body and a detached second end, the second knitted strap extending lengthwise from the first end to the second end and comprising a plurality of knitted courses extending in a widthwise direction of the second knitted strap, wherein at least a portion of the plurality of knitted courses comprises an elastomeric yarn.

Clause 3. The sock according to clause 2, wherein the first knitted strap extends from a lateral aspect of the collar, and wherein the second knitted strap extends from a medial aspect of the collar.

Clause 4. The sock according to any of clauses 2 through 3, wherein the second knitted strap is integrally knit with the collar of the sock body.

Clause 5. The sock according to any of clauses 1 through 4, wherein the sock body has a knit construction.

Clause 6. The sock according to any of clauses 1 through 5, wherein the first knitted strap is integrally knit with the collar of the sock body.

Clause 7. The sock according to any of clauses 1 through 6, wherein the first knitted strap further comprises a first longitudinal edge, a second longitudinal edge opposite the first longitudinal edge, a technical face, and a technical back.

Clause 8. The sock of clause 7, wherein the technical face extending from the first longitudinal edge is turned toward the technical back extending from the first longitudinal edge, and wherein the technical face extending from the second longitudinal edge is turned toward the technical back extending from the second longitudinal edge.

Clause 9. The sock according to any of clauses 7 through 8, wherein the first longitudinal edge is unaffixed from the second longitudinal edge along at least a portion of a length of the first knitted strap.

Clause 10. A knitted strap for a sock, the knitted strap comprising:

a first end, a second end, a first longitudinal edge, a second longitudinal edge opposite the first longitudinal edge, a technical face, and a technical back, wherein:

the knitted strap comprises a plurality of knitted courses extending widthwise between the first longitudinal edge and the second longitudinal edge, at least a portion of the plurality of knitted courses comprising an elastomeric yarn, the technical face extending from the first longitudinal edge is turned toward the technical back extending from the first longitudinal edge, and the technical face extending from the second longitudinal edge is turned toward the technical back extending from the second longitudinal edge.

Clause 11. The knitted strap according to clause 10, wherein the technical face extending from the first longitudinal edge is in contact or near contact with the technical face extending from the second longitudinal edge at the technical back of the knitted strap along at least a portion of a length of the knitted strap when the knitted strap is in a resting state.

Clause 12. The knitted strap according to any of clauses 10 through 11, wherein the first longitudinal edge is unaffixed from the second longitudinal edge along at least a portion of the length of the knitted strap.

Clause 13. The knitted strap according to any of clauses 10 through 12, wherein the first longitudinal edge is unaffixed from the second longitudinal edge along an entirety of the length of the knitted strap.

Clause 14. A method of forming a sock comprising:

knitting a first knitted strap using a first set of needles on a circular knit machine, the first knitted strap having a first end, a second end, a first longitudinal edge, a second longitudinal edge opposite the first longitudinal edge, a technical face, and a technical back, wherein knitting the first knitted strap comprises knitting a plurality of courses that extend widthwise between the first longitudinal edge and the second longitudinal edge of the first knitted strap, at least a portion of the plurality of courses comprising an elastomeric yarn;

knitting a second knitted strap using a second set of needles on the circular knit machine, the second knitted strap having a first end, a second end, a first longitudinal edge, a second longitudinal edge opposite the first longitudinal edge, a technical face, and a technical back, wherein knitting the second knitted strap comprises knitting a plurality of courses that extend widthwise between the first longitudinal edge and the second longitudinal edge of the second knitted strap, at least a portion of the plurality of courses comprising an elastomeric yarn; and knitting a sock body, wherein knitting the sock body comprises integrally knitting the first end of the first knitted strap and the first end of the second knitted strap with the sock body.

Clause 15. The method of forming the sock according to clause 14, wherein knitting the sock body includes knitting a collar that defines a foot opening.

Clause 16. The method of forming the sock according to clause 15, wherein the collar of the sock is knit using all the needles on the circular knit machine.

Clause 17. The method of forming the sock according to any of clauses 15 through 16, wherein the first knitted strap is knit to extend from a lateral aspect of the collar, and wherein the second knitted strap is knit to extend from a medial aspect of the collar.

Clause 18. The method of forming the sock according to any of clauses 14 through 17, wherein each of the first knitted strap and the second knitted strap is knit using a reciprocal knitting action on the circular knit machine.

Clause 19. The method of forming the sock according to any of clauses 14 through 18, wherein the technical face extending from the first longitudinal edge turns toward the technical back extending from the first longitudinal edge when the first knitted strap and the second knitted strap are in a resting state, and wherein the technical face extending from the second longitudinal edge turns toward the technical back extending from the second longitudinal edge when the first knitted strap and the second knitted strap are in the resting state.

Clause 20. The method of forming the sock according to clause 19, wherein the technical face extending from the first longitudinal edge is in contact or near contact with the technical face extending from the second longitudinal edge at the technical back of the first knitted strap and the second knitted strap along at least a portion of a length of the first knitted strap and the second knitted strap when the first knitted strap and the second knitted strap are in the resting state.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A sock comprising:

a sock body having a collar; and at least a first knitted strap having a first end extending from the collar of the sock body and a detached second end, the first knitted strap extending lengthwise from the first end to the second end and comprising a plurality of knitted courses extending in a widthwise direction of the first knitted strap, wherein at least a portion of the plurality of knitted courses comprises an elastomeric yarn and a non-elastomeric body yarn, wherein the elastomeric yarn is plated with the non-elastomeric body yarn such that the non-elastomeric body yarn is positioned on a technical face of the first knitted strap and the elastomeric yarn is positioned on a technical back of the first knitted strap, wherein, based at least in part on tension imparted by the elastomeric yarn, the technical face extending from a first longitudinal edge of the first knitted strap is turned toward the technical back extending from the first longitudinal edge and the technical face extending from a second longitudinal edge of the first knitted strap is turned toward the technical back extending from the second longitudinal edge to form a tubular-like structure for the first knitted strap.

2. The sock of claim 1, further comprising a second knitted strap having a first end extending from the collar of the sock body and a detached second end, the second knitted strap extending lengthwise from the first end to the second end and comprising a plurality of knitted courses extending in a widthwise direction of the second knitted strap, wherein at least a portion of the plurality of knitted courses comprises an elastomeric yarn.

3. The sock of claim 2, wherein the first knitted strap extends from a lateral side of the collar, and wherein the second knitted strap extends from a medial side of the collar.

4. The sock of claim 1, wherein the sock body has a knit construction and the first knitted strap comprises a tighter knit structure than the sock body.

5. The sock of claim 4, wherein the tighter knit structure comprises smaller knit stitches, as compared to the knit construction of the sock body.

6. The sock of claim 5, wherein based at least in part on the smaller knit stitches, the technical face is turned toward the technical back to form the tubular-like structure for the first knitted strap.

7. The sock of claim 1, wherein the first longitudinal edge is unaffixed from the second longitudinal edge along at least a portion of a length of the first knitted strap.

8. A sock comprising:

a sock body having a collar; and at least a first knitted strap having a first end extending from an edge of the collar of the sock body and a detached second end, the first knitted strap extending lengthwise from the first end to the second end and comprising a plurality of knitted courses extending in a widthwise direction of the first knitted strap, at least a portion of the plurality of knitted courses comprising an elastomeric yarn, wherein the first end of the first knitted strap has a greater width than the second end of the first knitted strap, wherein the first knitted strap comprises a tubular-like structure, and wherein the second end comprises an aglet;

wherein the portion of the plurality of knitted courses further comprises a non-elastomeric body yarn, wherein the elastomeric yarn is plated with the non-elastomeric body yarn such that the non-elastomeric body yarn is positioned on a technical face of the first knitted strap and the elastomeric yarn is positioned on a technical back of the first knitted strap.

9. The sock of claim 8, further comprising a second knitted strap having a first end extending from the edge of the collar of the sock body and a detached second end, the second knitted strap extending lengthwise from the first end to the second end and comprising a plurality of knitted courses extending in a widthwise direction of the second knitted strap, at least a portion of the plurality of knitted courses comprising an elastomeric yarn, wherein the first end of the second knitted strap has a greater width than the second end of the second knitted strap, and wherein the second knitted strap comprises a tubular-like structure.

10. The sock of claim 8, wherein the aglet is configured to retain at least a portion of the first knitted strap in the tubular-like structure.

* * * * *